US006769548B2

(12) United States Patent
Morell et al.

(10) Patent No.: US 6,769,548 B2
(45) Date of Patent: Aug. 3, 2004

(54) V-CHANNEL PACKING ARRANGEMENTS PARTICULARLY FOR WINDSHIELDS

(75) Inventors: Ramon B. Morell, East Brunswick, NJ (US); Brian Steiner, Bridgewater, NJ (US)

(73) Assignee: Pioneer Box Company, Inc., Bridgewater, NJ (US)

( * ) Notice: Subject to any disclaimer, the term of this patent is extended or adjusted under 35 U.S.C. 154(b) by 210 days.

(21) Appl. No.: 10/193,888

(22) Filed: Jul. 12, 2002

(65) Prior Publication Data

US 2004/0007493 A1 Jan. 15, 2004

(51) Int. Cl.[7] ..... B65D 81/02
(52) U.S. Cl. ..... 206/586; 206/454
(58) Field of Search ..... 206/448, 451, 206/453, 454, 583, 586, 591, 592, 587

(56) References Cited

U.S. PATENT DOCUMENTS

| | | | | | |
|---|---|---|---|---|---|
| 2,663,417 | A | * | 12/1953 | Kincaid | 206/453 |
| 2,741,362 | A | * | 4/1956 | Cortright | 206/453 |
| 2,807,360 | A | * | 9/1957 | Nurre | 206/448 |
| 3,416,652 | A | * | 12/1968 | Almasy | 206/453 |
| 3,955,677 | A | * | 5/1976 | Collingwood | 206/453 |
| 4,182,450 | A | | 1/1980 | Kryger | |
| 4,225,043 | A | | 9/1980 | Lastik | |
| 4,287,990 | A | | 9/1981 | Kurick | |
| 4,353,466 | A | | 10/1982 | Pater | |
| 4,679,525 | A | | 7/1987 | Curtze | |
| 4,700,844 | A | | 10/1987 | Griffith | |
| 4,784,269 | A | | 11/1988 | Griffith | |
| 4,805,774 | A | | 2/1989 | Salisbury | |
| 4,883,179 | A | * | 11/1989 | Dionne | 206/523 |
| 4,899,880 | A | | 2/1990 | Carter | |
| 5,042,665 | A | | 8/1991 | Liebel | |
| 5,269,422 | A | | 12/1993 | Chevrette | |
| 5,644,898 | A | | 7/1997 | Shephard et al. | |
| 5,678,691 | A | | 10/1997 | Amado-Aguilar et al. | |
| 5,975,303 | A | | 11/1999 | Morell | |
| D418,057 | S | | 12/1999 | Morell | |
| 6,050,417 | A | | 4/2000 | Smith | |
| 6,149,009 | A | * | 11/2000 | DeNola | 206/586 |
| 6,352,605 | B1 | | 3/2002 | Hunt | |
| 6,364,111 | B1 | * | 4/2002 | Wilson, Jr. | 206/453 |
| 6,629,608 | B2 | * | 10/2003 | Hurley et al. | 206/586 |

* cited by examiner

*Primary Examiner*—Shian T. Luong
(74) *Attorney, Agent, or Firm*—Duane Morris LLP

(57) ABSTRACT

A packing structure supports an article in a carton, especially a generally trapezoidal vehicle windshield, to be shipped in a corrugated craft carton. The article (possibly a windshield) is suspended by spacers, preferably made of integral die cut and folded blanks, that form resilient cradles along the elongated edge of the article. The carton can be rectilinear, having at each end two spaced side walls coupled by an end wall, generally forming an internal channel portion of the carton, with corners at junctions of the end wall and the side walls. A spacer is arranged to fit into this channel, so as to bear against the sidewalls and the end wall. The spacer defines an elongated substantially V-shaped fold between two V-wall panels. The edge of the article rests in a bottom of the V-shaped fold. The spacer also has two bearing legs that can be coextensive with the V-wall panels. These legs stand in the corners of the internal channel of the carton. Spacers can be provided on two or four ends in opposed pairs. The pairs on the ends can be tapered for a trapezoidal windshield shape. A compression resistant pad can reinforce the bottom spacer. The top spacer can be placed under fillers so as to engage the article from all sides without undue clearance.

14 Claims, 5 Drawing Sheets

V-CHANNEL PACKING ARRANGEMENTS PARTICULARLY FOR WINDSHIELDS

BACKGROUND OF THE INVENTION

1. Field of the Invention

This invention generally relates to supporting structures for cushioning objects against mechanical shock during shipment and handling. A supporting arrangement is provided that is particularly advantageous for supporting irregular sheet-like shapes such as motor vehicle windshields in a standing or laid-flat orientation. A set of V-shaped supporting structures fit into the peripheral areas of a carton and preferably engage the top, bottom and lateral edges of a windshield or other irregular form. The windshield form may be trapezoidal, in which event the lateral V-shapes are tapered to engage the form snugly, and can be fixed to a carton wall to maintain a predetermined position relative to the form.

2. Prior Art

A variety of packaging products are known for cushioning articles during shipment, handling, storage and other situations in which there is a possibility of damage. The articles typically are protected in the first instance by an external box or carton. Damage to the shipped articles might occur in various ways. Short of damaging the contents, failure of the packaging can occur, presaging potential later damage to the articles because of loss of the protective function for which the container was designed.

Some typical types of damage to articles and/or their containers might result from fallover, inadvertent dropping over a vertical distance, lateral crushing, vertical crushing due to excessive weight loading in a stack, breach of a container by mechanical contact, rupture of seams or closures, loss of container integrity by wetting (especially for paperboard and corrugated craft), etc. Depending on the nature of the article, simple shock can damage the article even while the container envelope remains wholly intact.

It is naturally desirable to protect articles. However it is also appropriate to avoid unnecessarily heavy containers because of the associated expense. The expense of an unduly protective container structure is not limited to the cost of the container, but also may contribute to the shipping expense due to the weight or tare associated with the container and the additional volume of the container beyond the minimum size dictated by the article. Thus there are conflicting design choices to be made, with the optimal container being only just heavy and large enough to do the protective job needed in situations that are likely to be encountered by the container, with due regard to the probability of avoiding potential loss and the value of the article, if the container contents are indeed damaged.

A demanding sort of article for protection during shipping and handling is a glass sheet. Glass needs to be protected from impact. Glass is potentially sharp-edged and breakable. It is advantageously handled in an enclosure rather than directly. As a specific type of formed glass sheet, a windshield is likely to be stronger than a float glass pane of the same size, but on the other hand, is likely to be much heavier may be irregularly shaped, leading to added packaging demands.

U.S. Pat. No. D418,057—Morell discloses a die cut corrugated craft sheet that can enclose around a single windshield for protecting it in shipping. This sort of cover protects the windshield against damage from contact with smaller items, scratches and the like, but not against shock, for example from dropping the entire package from a truck or the like. Such a cover is useful, but does not contribute much in the way of independent support, as does an enclosing carton or box to carry the windshield. The cover functions are substantially limited to surface protection, i.e., wrapping.

One conventional way to protect an article is to provide a durable outer box or carton, and to insert a cushioning material between the article and the internal walls of the box or carton. The idea is to permit the cushioning material to yield resiliently and thus to damp the shock applied to the protected item when a shock is applied externally to the carton. The protected article becomes displaced within the carton. Such cushioning material can be rated for the compressive forces expected and for the weight and fragility of the product being protected. The resilience, damping character and thickness are chosen to provide optimal cushioning.

Cushioning material comes in many forms, and there are tradeoffs associated with the choice of material and how it is arranged. For example, highly resilient material may be a poor choice to protect frangible articles that are brittle or that are subject to resonance. Cushioning materials that are good for damping shocks may have a poor shape memory and become permanently deformed when compressed. Such materials are not effective if repeated shocks occur. If a cushioning material must be very thick, the size of the package becomes large.

An alternative approach that is possibly inconsistent with cushioning is to provide a heavy duty box or container and to support the article very durably therein. Packaging of this type is sometimes used for shipping a number of windshields in a stack, e.g., to an auto assembly plant. A heavy base and enclosing box holds a fixture that has receptacles for a number of windshields that are stacked and individually supported by the fixture. A heavy shipping fixture as described may be effective to protect a stack of windshields because it can only be moved with difficulty and is built of very heavy and durable structures. Such a fixture is heavy and is not justified for shipping single windshields or the like.

A possibly-ideal shipping container would have a carton that is somewhat larger than the article being protected, and has resilient damping structures that are just sufficient to protect the product against shocks applied in any direction, e.g., embedding or suspending the product at equal distance from all the container walls. However, the product may be irregularly shaped and need more protection in one direction compared to another. Also, packing material is less dense than the article and free to move (e.g., polystyrene peanuts), there is a danger that the product will settle into the packing material and not stay centered.

Polystyrene foam cushioning material can be molded in cushioning blocks that are substantially complementary with the product and fit between the product and the container walls. Shipping different objects, however, thus requires different custom sized and shaped blocks, which can be unwieldy or expensive.

Efforts have been made to provide lightweight paperboard supports as fixed spacers between edges of a protected article and internal walls of a carton. In U.S. Pat. No. 5,975,303—Morell, a die cut paperboard element is erectable into a deformable corner bumper pad that can be packaged, for example to engage between the outside corners of a rectilinear product and the inside corners of a protective carton.

It would be advantageous to provide an optimal container for products such as windshields, wherein the container or carton provides some protection for the product against shocks to the carton. The particular target shipping need is for cartons containing single windshields, shipped by normal commercial carriers such as United Parcel Service, Federal Express, the US Postal Service, etc. In this context, the windshields will be subject to only moderate danger or shock, perhaps typified a fall from a delivery truck. It would be advantageous to provide protection using elements that do not add undue volume or weight to the package.

Windshields are relatively heavy and are sheet-like, which factors lead to substantial load applied to an edge, if the windshield carton is placed upright on any of the edges or ends. Windshields are varied in shape, and it would be advantageous to provide a packing technique that is applicable to a wide range of sizes and shapes. Windshields are typically generally trapezoidal, i.e., wider at the bottom than the top, which presents additional challenges, if the packing technique is to employ a rectilinear outer carton.

SUMMARY OF THE INVENTION

It is an object of the invention to make the best use of the minimum amount of packing material needed to support and protect a substantially flat article such as vehicle windshield, for shipping, storage and handling in a protective carton.

It is an object to support the article (e.g., windshield) in opposed cradling structures formed in spacers that hold the edged of the article, somewhat resiliently, at a space from the carton inside walls.

Another object is optimally to form these cradling spacers to account for the packing challenges associated with windshields, including highly variable windshield dimensions for different vehicle makes and models, the particular trapezoidal and curving glass shape of many windshields, the substantial weight applied edgewise when the windshield is standing one end, etc.

The present invention provides an optimal solution for a shipping enclosure for windshields and other products with similar attributes. A packing structure supports the article in a carton, especially a generally trapezoidal laminated safety glass vehicle windshield, to be shipped in a corrugated craft carton. The article (windshield) is suspended by spacers, preferably made of integral die cut and folded blanks, that form resilient cradles along the elongated edge of the article. The carton can be rectilinear, having at each end two spaced side walls coupled by an end wall, generally forming an internal channel portion of the carton, with corners at junctions of the end wall and the side walls. A spacer is arranged to fit into this channel, so as to bear against the sidewalls and the end wall.

The spacer defines an elongated substantially V-shaped fold between two V-wall panels. The edge of the article rests in a bottom of the V-shaped fold. The spacer also has two bearing legs that can be coextensive with the V-wall panels. These legs stand in the corners of the internal channel of the carton. Spacers can be provided on two or four ends in opposed pairs. The pairs on the ends can be tapered for a trapezoidal windshield shape. A compression resistant pad can reinforce the bottom spacer. The top spacer can be placed under fillers so as to engage the article from all sides without undue clearance.

The spacer can have at least two distinct forms, for the top and bottom versus the opposed sides. Each of the preferred forms has at least one base panel, and possibly two base panels, coupled to a fold with at least one of the bearing legs, the base panel being folded to a position parallel to the end wall of the internal channel adjacent to an associated one of the corners of the internal channel.

A compression resistant material can be disposed between at least two of the end wall, the base panel and the bottom of the V-shaped fold. The lateral or carton-end spacers preferably accommodate a trapezoidal windshield shape. For this purpose, the V-wall panels increase in width along the spacer, whereby the bottom of the V-shaped fold is inclined relative to the end wall. Longitudinal shifting of any of the spacers would alter the depth of the V-shaped fold at a given point along the end wall of the carton. According to another aspect, the longitudinal position of the spacers with inclined folds is fixed, e.g., with a staple affixing a base part of the spacer to the carton or a spacing structure abutting the longitudinal end of the inclined-fold spacer. The spacing structure that fixes the inclined fold spacer can be a V-wall spacer on an adjoining end of the carton.

BRIEF DESCRIPTION OF THE DRAWINGS

There are shown in the drawings a number of preferred arrangements that should be construed as exemplary rather than limiting. In the drawings.

DETAILED DESCRIPTION OF THE PREFERRED EMBODIMENTS

Figure 1:
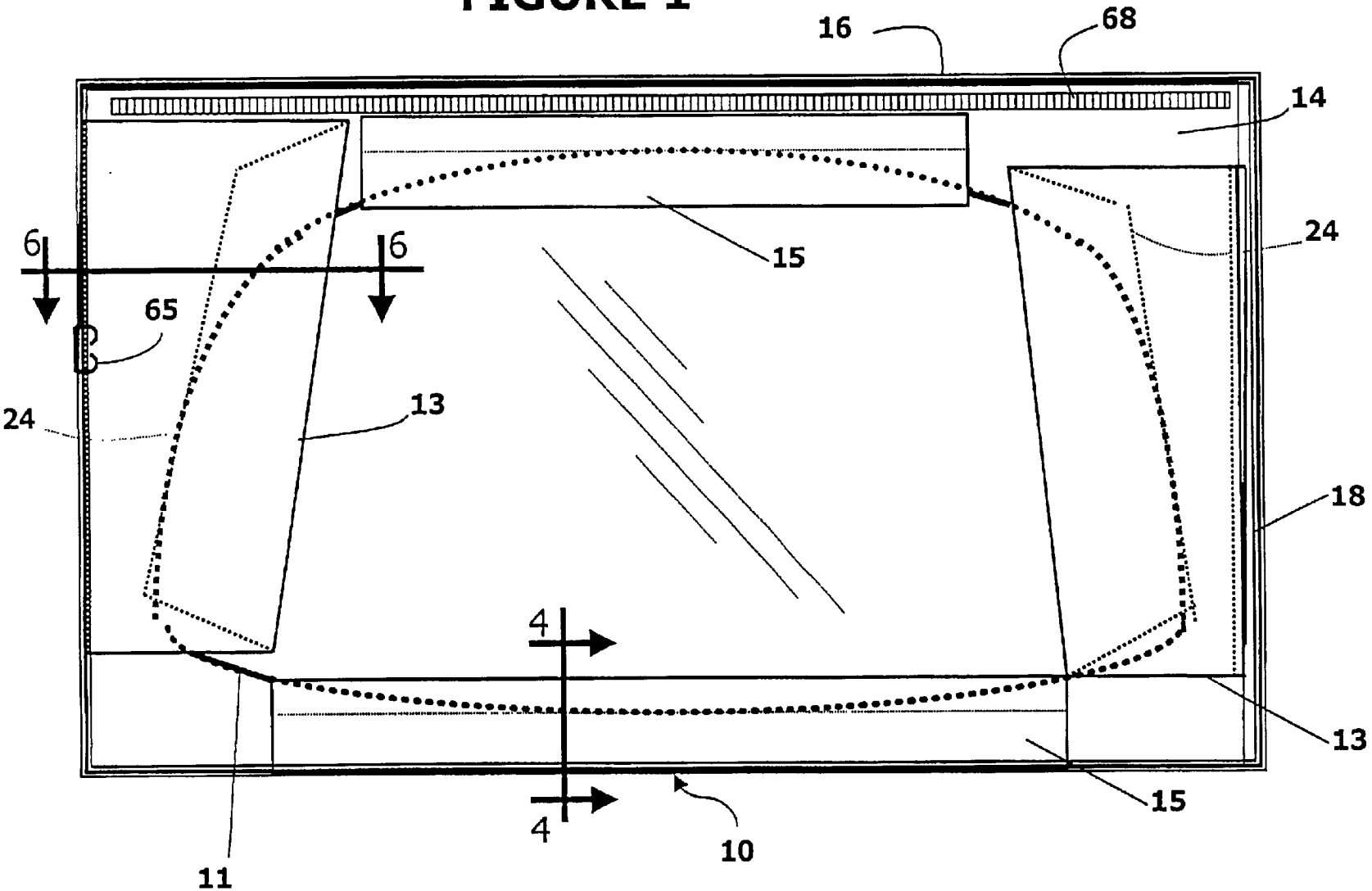
FIG. 1 is a sectional elevation view through an exemplary packing assembly according to the invention.

A packing structure according to the invention is shown in FIG. 1, for supporting an article 11 in a carton 10, especially a vehicle windshield in a corrugated craft carton. The article (e.g., windshield 11) is suspended by spacers 13, 15 that can essentially be integral die cut and folded blanks of the same corrugated material as the carton. The carton 10 forms spaced facing sidewalls 14, between top and bottom walls 16 and end walls 18, in a rectilinear form.

In the preferred examples, two forms of spacers 13, 15 are provided from folded die cut blanks. The blanks form resilient cradle structures that bear against the edges of the article 11 contained in the carton, and resiliently permit limited displacement while normally holding the article at a space from the inside walls of the carton 10. The invention is particularly apt for storage and shipping of single safety glass vehicle windshields, which are generally trapezoidal in elevation view and follow one or more axes of curvature around generally vertical axes.

In this description, a number of terms are employed that denote orientations and absolute or relative directions, such as "up," "down," "above," "below," "vertical," "horizontal," etc. It should be appreciated that such terms and expressions are used for convenience in referring to the drawing or to an alternative arrangement under discussion, and are not intended to limit the subject matter to any particular orientation or relative position, unless so stated or if necessary to the function being discussed. Also, throughout the drawings and this description, the same reference numbers have been used to refer to the same elements in the respective embodiments and in the different views.

The exemplary carton 10 as shown is rectilinear, having at each end two spaced side walls 14 (the inside of the rearward one being visible in FIG. 1), coupled by end walls 18 and top/bottom walls 16. Whether considering the left or right end walls 18 or the top and bottom walls 16 in FIG. 1, the end and adjacent sides, or the top or bottom and the adjacent sides, generally form an internal channel. According to the invention, spacer elements 13, 15 are provided in opposed pairs, and reside in these carton channels on opposite parts of the carton 10, to hold the article 11 therein. The article is a windshield in the example shown.

Two forms of spacers are shown in FIG. 1, namely end spacers 13, which define an inclined cradling contour, and top or bottom spacers 15, which have a cradling contour that is substantially flat. Depending on the nature of the article (e.g., windshield), it is possible to choose the form of spacer, and perhaps to choose among a set of spacers having different angles of incline, to best suit the article being carried.

In each case, a spacer 13 or 15 is arranged to fit into the channel defined by the inside walls of the carton (top, bottom or end). The spacer bears against the sidewalls 14 and at least one of the end walls 16 or 18. Each spacer defines an elongated substantially V-shaped fold between two V-wall panels. The edge of the article rests in a bottom of the V-shaped fold.

Each spacer has two bearing legs that can be coextensive with the V-wall panels, or preferably are wider such that the bearing legs fit into the corners of the carton (between the side and end walls) and hold the V-wall panels such that the cradling bottom of the V-shape is spaced from the associated end wall.

Spacers as described can be provided on two or four ends in opposed pairs. For a squared article (e.g., a windshield that is rectangular in elevation view such as a truck windshield pane, a vehicle side window, etc.), the spacers can be all the same, with V-shapes that are parallel to the end walls. For trapezoidal windshields, preferably the pairs of spacers on the ends of the carton are inclined relative to the container walls, and those on the top and bottom have V-shapes parallel to the container walls.

At least a bottom spacer, and preferably both the top and bottom spacers 15, preferably is reinforced by a compression resistant pad. In the absence of any external labeling or requirements as to "this side up," all the spacers can have compression pads.

The top spacer preferably is reinforced with a spacer pad, which can be the same type or a different type from the bottom spacer pad as discussed below. Furthermore, to accommodate articles of different height in the same size carton 10, one or more filler panels that fill out the vertical space in the carton 10 preferably supplement the top spacer. In this way, all the spacers bear against the inside surfaces of the carton walls, with no substantial clearance that would permit undue relative displacement of the article 11 in the carton 10.

In FIG. 1, the carton 10 is shown in longitudinal section, carrying an exemplary product such as a motor vehicle windshield 11, shown in broken lines. The illustrated embodiment generally uses two different forms of packing or spacing element, for the top and bottom of the windshield on the one hand, and the lateral ends the windshield on the other.

Windshields are generally somewhat curved. An exemplary windshield, for example for an automobile, defines part of a conical surface. As finally mounted on the vehicle, the windshield generally curves somewhat around part of the front portion of a vehicle, is wider at the bottom and narrower at the top, and has a flatter curve (a longer radius of curvature) in the middle portion as compared to the sides. In the elevation view shown in FIG. 1, the windshield 11 is placed to extend substantially along a midline of the carton 10 for storage or shipping. The carton is somewhat deeper (referring to the space between the sidewalls 14) than the span of the curve of the windshield 11. Thus the supporting structure holds the windshield 11 at a space from both opposite faces 14 of the carton inside walls, as well as protecting the windshield 11 from damage from shock, for example should the carton be dropped.

For example, the middle area of the windshield on the outer side of its curve, and the lateral ends of the windshield on the inner side of the windshield's curve, preferably are carried at least two inches (5 cm) from the inside wall of the carton, and preferably are up to four inches (10 cm) back from the inside opposite carton face walls. In a preferred embodiment, the carton is about 10 inches in width (25 cm). The precise spacing between the windshield and the carton, however, depends on the contour of the windshield and is generally between two and four inches.

The invention is fully applicable to shipment of other articles, which might or might not comprise glass and could be of different but still somewhat flat shape. The invention is applicable, for example, to rear and side windows for vehicles, to door and window structures and to other similar sheet-like forms.

The carton can be relatively heavy or light, as needed for the particular size and weight of the windshield of other article. For a typical automobile windshield, a 275 PSI burst strength double-walled corrugated craft material is preferred. The total tare weight of the carton, including the packing as described, can be on the order of 20 to 25 lbs. The windshield is likely to weigh a comparable amount, such that the entire package might weigh approximately 50 lbs. (20 kg).

According to the generally conventional form of windshield 11, as described, the windshield is generally trapezoidal, shown in FIG. 1. In order to support the windshield in the carton 10, according to an inventive aspect there are two distinct types of spacers 13, 15, each having an outwardly facing shape that is rectangular and fits supportingly into the channel defined by the adjacent walls 14, 16 or 14, 18 of the carton 10. The spacers 13, 15 have inwardly facing shapes that receive and cradle the edge of the article (windshield), while supporting the windshield 11 at a space from the container walls.

Figure 4:
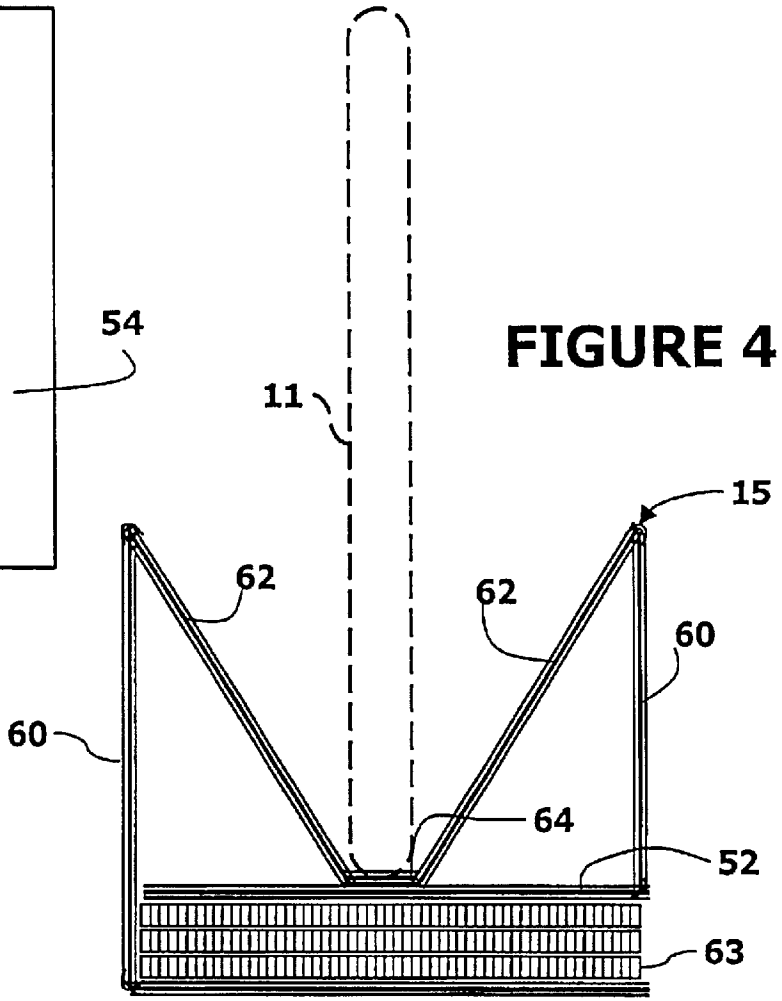
FIG. 4 is a section view along line 4—4 in FIG. 1.
Figure 6:
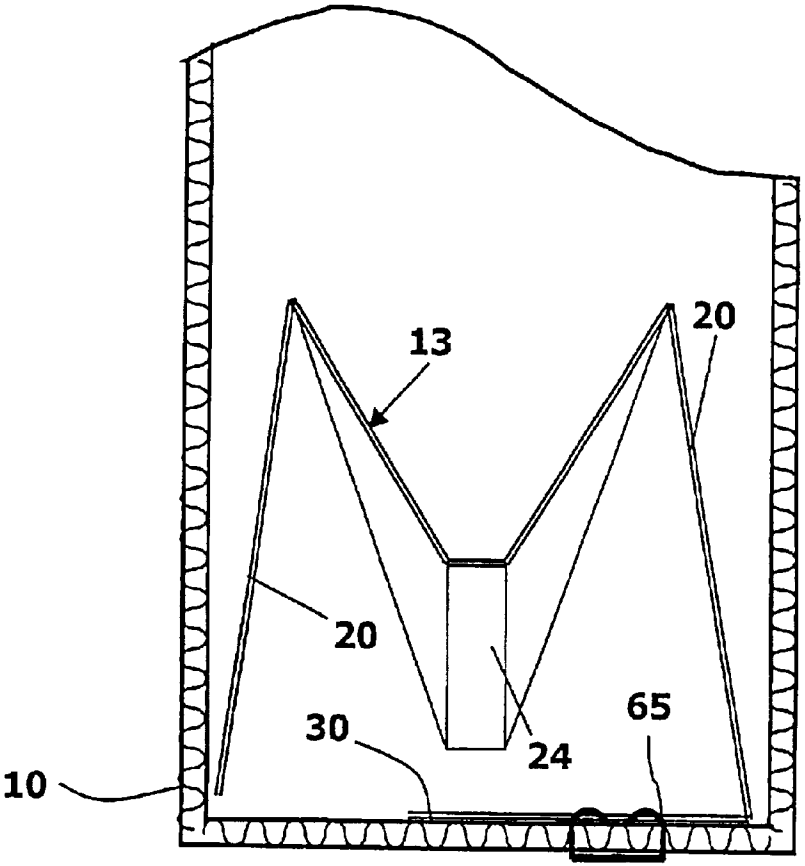
FIG. 6 is a section view taken along line 6—6 in FIG. 1, illustrating an end support spacer with an alternative configuration.
Figure 7:
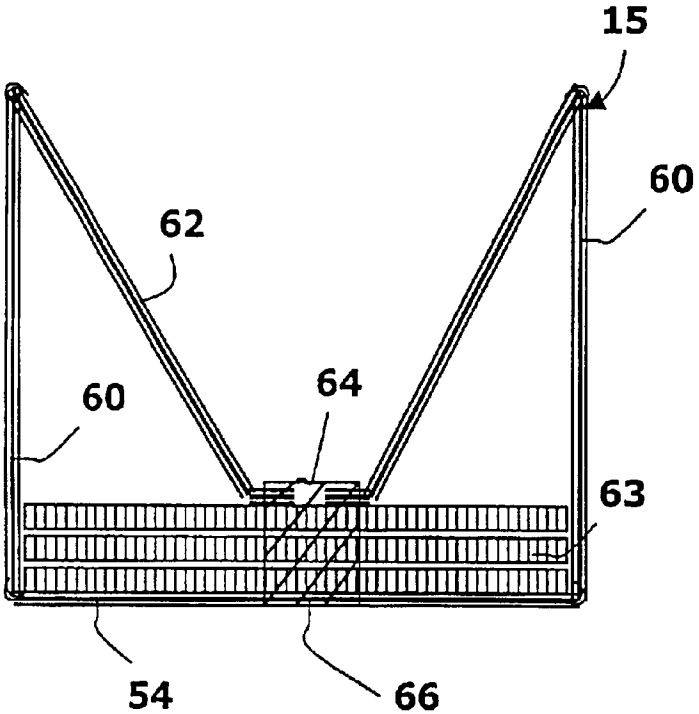
FIG. 7 is a section view through a bottom spacer as in FIG. 4, illustrating another alternative fold arrangement.

FIG. 1 shows both forms of spacers as well as the carton and the windshield. FIGS. 2, 5, 6 and 8 show spacer embodiments for supporting and cradling the generally inclined lateral edges of the windshield or other article. FIGS. 3, 4 and 7, show embodiments for supporting and cradling the top and bottom of the windshield. The embodiments shown in the drawings, namely with certain combinations of spacer types and positions, are intended to illustrate the versatility of the invention. It will be appreciated, however, that the invention is also applicable to packing arrangements in which only one form of spacer 13 or 15 is used, or an arrangement characterized by a different specific placement of the spacers 13 or 15, as compared to the examples that are shown and described.

In FIG. 1, side spacers 13 form inclined cradles that substantially complement at least part of the lateral edges of the generally trapezoidal form of windshield 11. These spacers define a V-channel that has a bottom 24 that is inclined outwardly and downwardly. In the embodiment shown the V-channel thereby formed varies in depth. The V-channel could have an equal depth or a different spacing arrangement between the bottom and top edges of the V-channel, and still define a bottom that is inclined downwardly and outwardly. In the position of the carton 10 shown in FIG. 1, the windshield 11 is upright and the side spacers have a deeper V-dimension at bottom of the carton and are shallower at the top, to complement the windshield shape.

This arrangement is not simply a matter of gravity, although gravity is a factor in how the packaging is assembled, as described below. The same arrangement could be positioned upside-down, compared to the orientation shown in FIG. 1, in which case the windshield would taper downwardly and inwardly.

The outer edges of the spacers, both the lateral spacers and the top and bottom spacers, form leg panels that conform with and can lie against the carton inside walls. The outer edges of the lateral spacers are vertical as shown and those of the top and bottom spacers are horizontal. The spacers are substantially as wide as the carton is deep, namely occupying the internal space in the carton between the facing sidewalls of the carton.

Figure 2:
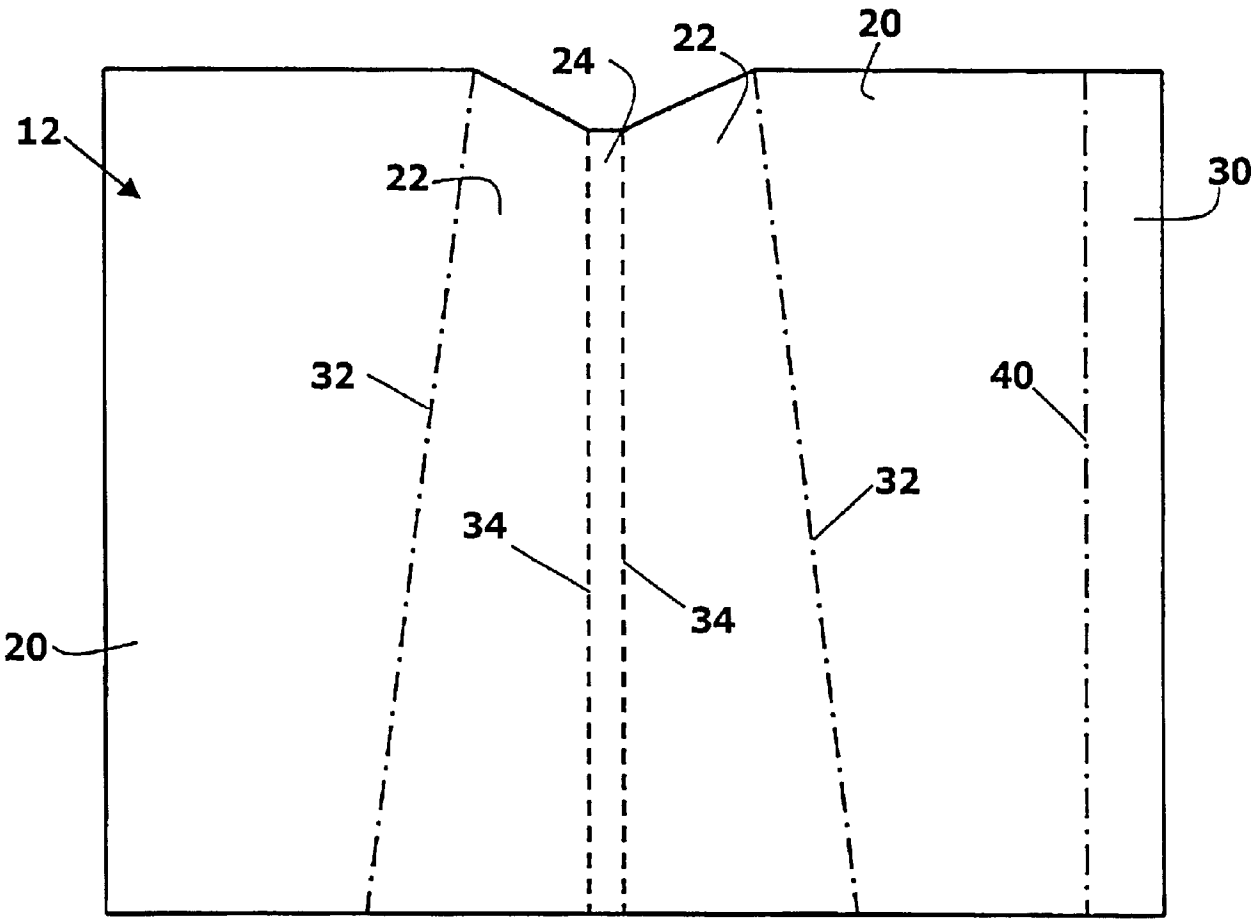
FIG. 2 is a plan view of a die cut sheet having certain folds, for the end support spacers in FIG. 1.
Figure 3:
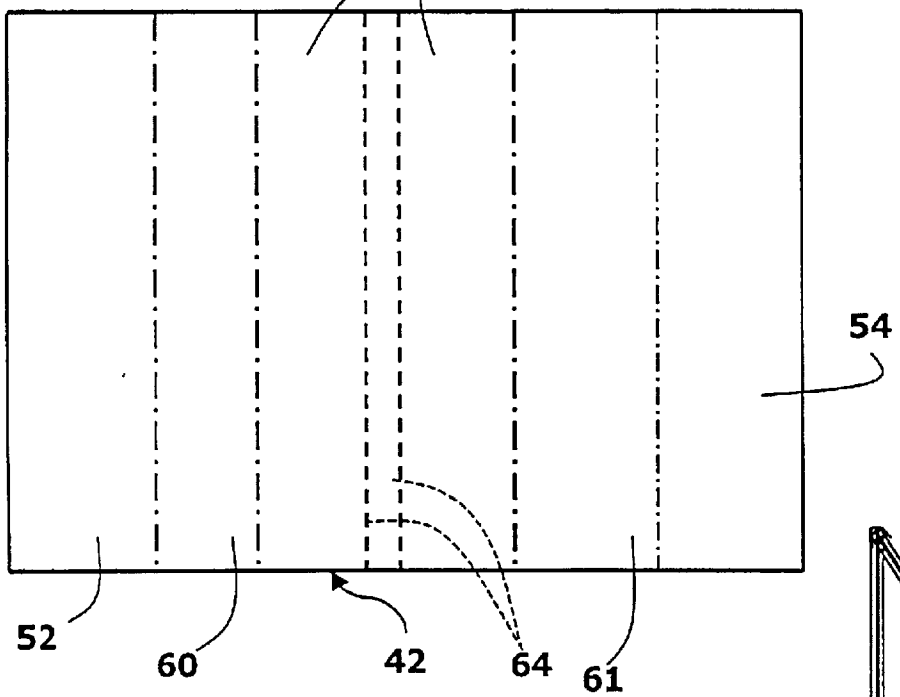
FIG. 3 is a plan view of a die cut sheet having certain folds, for the top and bottom support spacers in FIG. 1.
Figure 5:
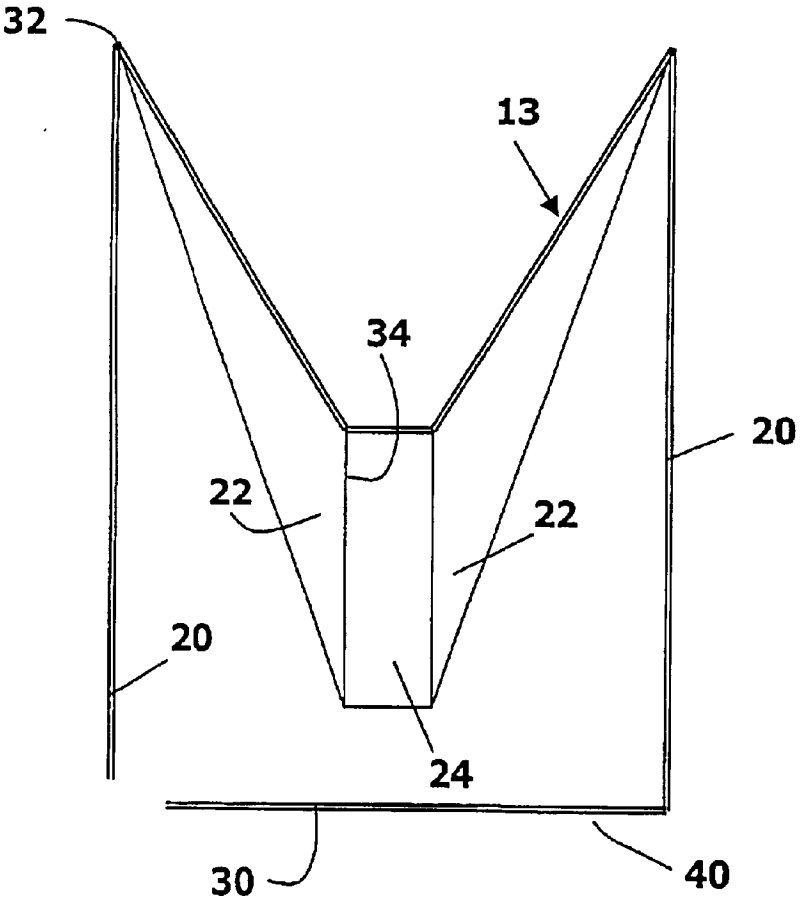
FIG. 5 is a top view of an end support spacer substantially as shown in FIG. 1.

The lateral side spacers 13 in the embodiment shown preferably are cut and folded in one integral die cut sheet 12, an exemplary layout being shown in FIG. 2. An end view of this spacer, as erected, is shown in FIG. 5. Generally, the side spacer 13 has two leg panels 20 that lie against the faces of sidewalls 14 on the inside of the carton 10. The ends of the leg panels 20 (functionally their feet) abut the adjacent end wall of the carton at the corner between the associated end wall 16 or 18 and the side wall 14.

The leg panels 20 are coupled at folds to V-walls 22. The V-walls 22 depend from folds at the inside edges of the leg panels 20 and form a V-shaped converging channel. The bottom of the V-shaped channel supports the edge of the windshield 11 or other article.

In FIG. 2, the integral die cut sheet 12 has a rectangular outer perimeter and several straight score lines, not all of which are parallel to the perimeter edges. The "score" lines can be actual scores, i.e., shallow cuts, or can be perforations, broken-line cuts, compressed lines in the corrugations, etc., at which the material easily folds.

Two outside ones 32 of the score lines are non-parallel relative to the edges of the rectangular perimeter and generally tend to converge. Inside of outside score lines 32 are two parallel, closely spaced score lines 34. The blank is folded in one direction at the outside score lines 32, and in the opposite direction at the inside score lines 34 in the opposite direction (shown by dot-dash versus dotted lines, respectively). This divides the die cut panel 12 into a set of flat panels connected at folds.

The V-walls 22 are carried on leg panels 20 and form the bottom 24 of a V-groove that supports and engages the lateral edge of the article 11 as shown in FIG. 1. In the embodiment shown, the bottom of the groove 24 is inclined relative to the end wall 18 of the carton, thereby providing a supporting structure that is complementary with the trapezoidal shape of the windshield 11.

The leg panels 20 that support the V-walls 22 on the sides of the V-groove or channel, generally stand on the ends of leg panels 20. The leg panels 20 can be precisely perpendicular to the base panel 30 as in FIG. 5, or can be inclined inwardly as shown in FIG. 6. One objective of the end support 13 is to bear shocks by providing a resilient point of support for the edge of the article (windshield) 11. Referring to FIG. 6, an inertial force would be exerted edgewise and outwardly by the article (downward in FIG. 6) if the carton were to be dropped on its end 18 to strike a solid object such as the ground. The cradling structure of end support 13 acts like a sling. Force in this direction tends to be borne as compression in the plane of the leg panels 20 and also tends to divert the end panels inwardly toward one another in a flexing compression. The structure cushions the shock to the article while normally preventing the edge of the article from being displaced against the inside wall 18, where the shock is probably being applied (e.g., the carton has been dropped on wall 18). For added protection it is possible to place one or more compression pads between the bottom 24 of the V-channel slot and the inside of carton wall 18 (not shown in FIG. 6).

Referring to FIG. 2, one of the leg panels 20 of the end support 13 is coupled at a fold 40 to a base panel 30. FIG. 5 shows that this base panel can extend across the end wall 18, under the end support 13 (in these views, the carton 10 is up on its end). The base panel 30 can extend all the way across the end wall 18 or only part way. It is also possible to provide base panels on both leg panels 20, instead of one as shown. The fold 40 for base panel 30 is made in the same direction as the next fold 32, so that base panel 30 rests against the inside surface of the carton end wall 18.

The foregoing structural relationships and folds in the die cut sheet 12 form a channel with an inclined V-shaped channel, shown in FIGS. 1 and 5. In the embodiment shown, the bottom of the V-shaped channel has a predetermined width equal to the space of panel 24 between closely spaced folds 34. It would be possible to only have only one fold 34, with no defined width comparable to panel 24. The edge of the article in that case simply rests in the bottom of the fold between V-walls 22. The embodiment shown in the drawings is preferred, however, including providing at least some flat panel width by panel 24 at the bottom of the V-channel, because this width helps to accommodate a windshield or other article that has a curve in the plane of the V-channel. The width allows the article to sit and fit snugly in the V-shaped channel as shown.

The upper and lower spacers 15 in the embodiment shown in FIG. 1 are also characterized by V-channel structures. However, the bottom of the V-channels formed by these spacers 15 is preferably parallel to the top and bottom walls 18 of the carton 10. Additionally, the top and bottom spacers preferably include a compressible pad 63, embodiments being shown in FIGS. 4 and 7.

The upper and lower "straight" V-channel support structures can have several alternative structures that preferably incorporate a compressible pad 63. The pad 63 is arranged between the bottom of the V-groove and the comparable base panel 54 of the side spacers 15. In FIG. 4, the top/bottom support structure is formed of a single die cut blank 42 and is folded using the fold arrangements shown in FIG. 3 to provide the support 15 for the article 11 as shown. In this embodiment the two endmost panels 52, 54 are overlapped at a space and a spacer formed by a stack of corrugated sheets or an endwise corrugated or honeycomb fill material is place between the panels.

FIG. 7 shows an alternative embodiment in which the spacer pad 63 is placed directly under the edges forming the bottom of the V-channel. The embodiment of FIG. 4 does not require substantial assembly other than folding. The die cut blank 42, shown in FIG. 3, is folded upwardly at lines 64 bordering the narrow panel that forms the bottom of the channel. The other folds are in the opposite direction and form V-walls 62, folded to leg walls 60, one of which is longer than the other to offset the attached base walls 52, 54. The spacer 63 slides between base walls 52, 54.

An alternative embodiment, shown in FIG. 7, is symmetrical and uses less material in the die cut blank. The edges of the blank are brought together at the bottom of the V-channel, and preferably also are attached using tape 66. It is also possible to forego the tape by having the perimeter edge of the blank occur between the base 54 and one of the leg panels 60. Like the side supports 13, the top/bottom supports are positively positioned because they are sized to fit precisely in the inside volume of the carton, especially between the front and rear wall 14, shown in FIG. 5. This ensures that the carton wall help to hold the support structures erect, and part of any forces are borne by the carton walls and the structure of the corners of the cartons.

The combined vertical dimension of the windshield 11, and the top/bottom supports, preferably just equals the internal height of the carton 10. In order to make up additional vertical height if the windshield height plus the spacers is less than the carton height, one or more additional spacers 68 are inserted between the top spacer 15 (and/or the bottom spacer 15) and the adjacent top (and/or bottom) carton wall 16. Filling the available height prevents relative displacement of the windshield and the spacers 15 and/or carton 10.

The side spacers 13 have an additional complication because the bottom 24 of the V-channel is inclined outwardly and downwardly in FIG. 1. Thus the vertical position of the side spacers 13 affects the later width available for the windshield 11 and the supporting side spacers 13, between the end walls 18 of the carton 10.

The side spacers 13 can be dropped into the area between the ends of the windshield 11 and the carton end wall 18, and by gravity will fall to the point at which the bottom 24 of the V-channel rests against the inclined lateral edge of the windshield. According to an inventive aspect, however, the vertical position of at least one and preferably both side spacers 13 is positively fixed so as to fix and control the available lateral dimension for the windshield.

One structure to achieve a fixed lateral dimension would comprise end spacers 13 that are as high as the volume of the carton 10 (not shown in FIG. 1). In that case, the top/bottom walls 15 of the carton fix the vertical position of the end spacers 13, and thereby also fix the lateral space between spacers 13. A drawback of that arrangement is that the spacers 13 must be dimensioned specifically for a particular windshield dimension.

As shown in the top-left corner of FIG. 1, the end spacers 13 can abut against the top (or bottom) 18 of the carton to fix the vertical position of the end spacers 13. As shown in the bottom-right corner, the vertical position of the end spacers 13 can be fixed by their resting atop another fixed structure such as one of the top/bottom spacers 15. According to an inventive aspect, however, the vertical height of one or both of the end spacers 13, that have inclined V-channels 24, is fixed by positively attaching the respective end spacer 13 at a fixed height on the end wall 18. In FIG. 1, this is accomplished by a staple 65 or by another fastening technique (e.g., adhesive) or a different particular fastener structure.

Preferably, both spaced end spacers 13 are attached by fasteners to their associated end walls. Also, both end spacers 13 are vertically shorter than the available vertical dimension in the area of spacers 13, providing a span of vertical displacement. This span of displacement provides a corresponding span of lateral space adjustment, due to the inclined nature of the V-channel bottom 24. As a result, a given set of spacers in a given size of carton can accommodate windshields that have a range of vertical and horizontal spans.

The top and bottom spacers 15 can be provided in different thicknesses (vertical dimensions) or for spacers of a given thickness, additional compression pad(s) 68 make up the vertical space in the carton. The lateral or end spacers 13 are set and fixed at the vertical position needed to fill out the horizontal space. Thus the windshield his securely and resiliently supported.

The add-in compression pads 68 and the assembled compression pads 63 in the spacers 15 can be of various materials. A stack of corrugated sheets is one form of compression pad. Other possibilities include resilient foam pads, honeycomb-cell packing, polystyrene pads, Susrap paperboard, etc. Such padding material can be provided in an integral block or in a collection of smaller blocks that are abutted against one another or spaced from one another. Although the compression pads are primarily discussed with respect to the top and bottom spacers 15, it is also possible to provide compression pads in association with the end spacers 13, namely between the bottom 24 of the V-channel and the associated carton end wall 18, or in the space between the V-panels 22 and leg panels 20.

The top and bottom spacers are structured such that the bottoms of their V-grooves are parallel to the carton walls. The V-grooves can be inclined on the top and bottom, like those of the sidewalls. This may be appropriate to follow a generally downward-and-outward inclining top and/or upward-outward inclining bottom of a windshield, as in the windshield shown in FIG. 1. In that case, the straight top/bottom spacers 15 as in FIG. 1 can be replaced by or supplemented with two inclined bottom spacers engage along outer portions of the top and bottom and taper in the required direction to complement the windshield. Similarly, it is possible to use the same carton to accommodate an article that is wholly rectilinear. In that case, a set of straight bottom spacers 15 can be provided around the periphery of the article.

Figure 8:
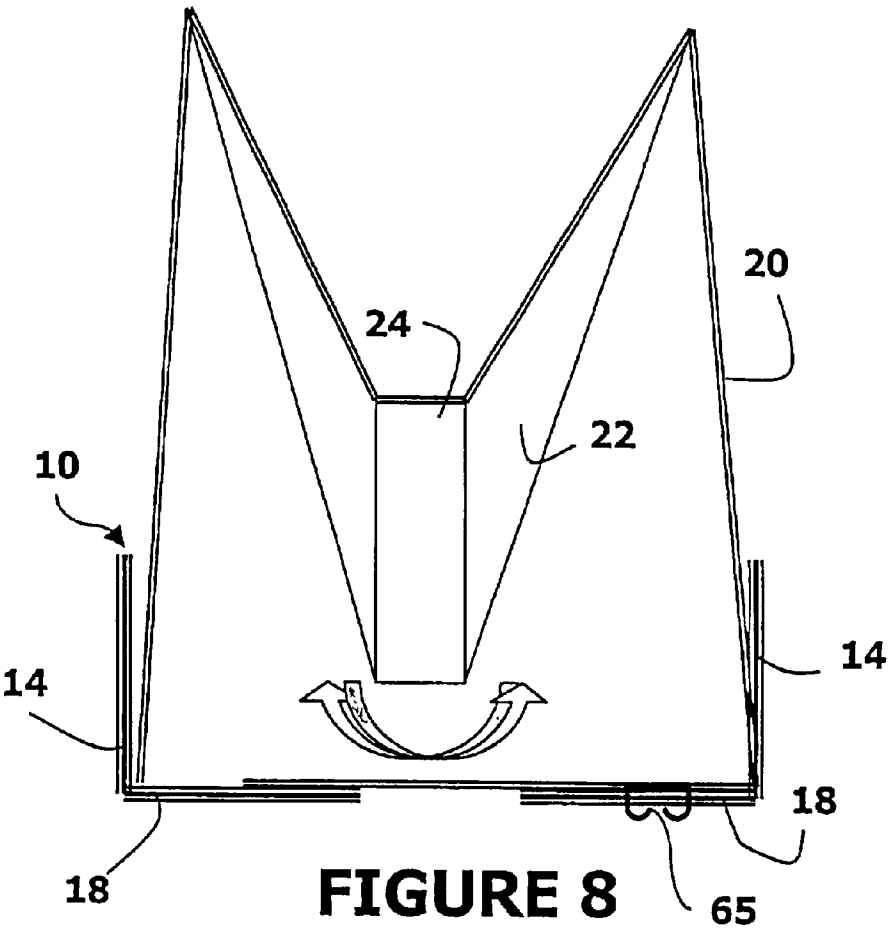
FIG. 8 is a schematic view illustrating the cradling operation of the end spacers according to the invention.

Referring to FIG. 8, the sidewalls 14 and end walls 18 of carton 10 provide a confining channel for the spacer, an inclined end spacer being shown. The load of the windshield or other article and shocks that are applied are borne by the leg panels 20 standing in the confining channel and carrying a sling on their upper ends, defined by V-walls 22, and in this case the flat channel bottom panel 24. Fastener 65 fixes the placement of the spacer. If a shock is applied endwise (downward in FIG. 8), the compression of legs 20 and tension on V-walls 20 supports the bottom panel and the article it carries (not shown in FIG. 8). This shock is also alleviated in part by the fact that the legs 20 are free to pivot resiliently inwardly and outwardly toward and away from one another at their tops, translating into limited vertical displacement of panel 24. For shocks applied perpendicular to the side walls 14, the structure permits the sling defined by bottom 24 and V-panels 22 to swing somewhat in the direction shown by the arrows, also providing resilient support.

Accordingly, the invention provides a packing structure for an article 11 that has an elongated edge. The carton 10 provides at least a partial enclosure with spaced side walls 14 coupled by an end wall 18, defining an internal channel with corners at junctions of the end wall and the side walls as seen in FIGS. 6 and 8 for the end spacers 13 and which is substantially the same for the top/bottom spacers 15. At least one such spacer 13, 15 is arranged to fit into the channel, so as to bear against the side walls 14 and the end wall 18, the spacer defining an elongated substantially V-shaped fold between two V-wall panels 22 or 62, arranged to receive the edge of the article 11. An edge of the article 11 rests in a bottom of the V-shaped fold, which can also have a panel portion 24, 64 of a limited width. The spacer 13, 15 has two bearing legs 20, 60, namely elongated panels respectively coupled to the V-wall panels 22, 62. The bearing legs 20, 60 extend from a fold at a junction with one of the V-wall panels 22 to one of the corners of the internal channel, e.g., a right angle fold between a side wall 14 and end wall 18.

Preferably, the spacer 13, 15 has at least one base panel 30, 52, 54, coupled to a fold with one or both of the bearing legs 20, 60. This base panel is folded to a position parallel to the end wall 18 of the internal channel adjacent to an associated one of the corners of the internal channel.

A compression resistant material 63 can be disposed between at least two of the end wall 18, the base panel 52, 54, 30 and the bottom 24, 64 of the V-shaped fold. At least one of the spacers 13 can be inclined, for accommodating an inclined article or simply for adjusting a dimension in which the article is supported. In the embodiments shown, the V-wall panels of laterally opposite spacers 13 define a lateral dimension or width that increases along the spacers 13 (e.g., from top to bottom of the carton in FIG. 1). For a rectilinear layout for carton 10, this occurs because the bottom 24 of the V-shaped fold or channel is inclined relative to the end wall 18. According to another aspect, the spacer 13 is fixed relative to at least one of the sidewalls 14 and the adjacent end wall 18, against displacement along a length of elongation. As a result, the V-shaped fold is fixed in operative depth and/or the lateral space between the opposed spacers 13 is fixed at any position along the channel. In the embodiment shown, the structure fixing the spacer 13 comprises at least one of a fastener 65 affixing the spacer 13 to one of the side walls and end wall, namely by stapling the base 30 of the spacer 30 to end wall 18, or a spacing structure or relationship between structures is provided by abutting an end of the spacer 13 as shown in FIG. 1.

In the examples shown, the spacer 13 or 15 has at least one base panel 30, 52, 54, coupled to a fold with at least one of the bearing legs 20, 60, folded to a position parallel to the end wall 18. The preferred enclosure comprises a rectilinear carton 10 having spaced side walls 14, coupled at ends of the carton with two end walls 18, and being used by adjustments of the spacers to accommodate articles such as windshields over a range of specific sizes. At least two opposed ones of the walls 18 or 16 walls each are provided with at least one such spacer, and optionally with two or more abutting spacers. For support on four sides, the top and bottom walls 16 of the carton 10, and the end walls 18 of the carton, each contain opposed pairs of said spacers.

The invention having been disclosed in connection with certain preferred examples, variations employing the inventive aspects will now be apparent. The invention is not limited only to the examples discussed above, and reference should be made to the appended claims instead of the foregoing examples, to assess the scope of the invention in which exclusive rights are claimed.

What is claimed is:

1. A packing structure for an article with an elongated edge, the structure comprising:

at least a partial enclosure with spaced side walls coupled by an end wall, defining an internal channel with corners at junctions of the end wall and the side a spacer arranged to fit into the channel, so as to bear against the side walls and the end wall, the spacer defining an elongated substantially V-shaped fold between two V-wall panels, arranged to receive the edge of the article, with the edge of the article resting in a bottom of the V-shaped fold;

the spacer having two bearing legs comprising elongated panels respectively coupled to the V-wall panels, each of the bearing legs extending from a fold at a junction with one of the V-wall panels to one of the corners of the internal channel; and, wherein the spacer further comprises at least one base panel coupled to a fold with at least one of the bearing legs, the base panel being folded to a position parallel to the end wall of the internal channel adjacent to an associated one of the corners of the internal channel.

2. The packing structure of claim 1, further comprising a compression resistant material disposed between at least two of the end wall, the base panel and the bottom of the V-shaped fold.

3. The packing structure of claim 1, wherein each of the bearing legs has an associated said base panel.

4. The packing structure of claim 1, wherein each of the bearing legs has an associated said base panel, wherein the bottom of the V-shaped fold abuts against one said base panel and further comprising a compression resistant material between one said base panel abutting the V-shaped fold and another said base panel, disposed against the end wall.

5. A packing structure for an article with an elongated edge, the structure comprising:

at least a partial enclosure with spaced side walls coupled by an end wall, defining an internal channel with corners at junctions of the end wall and the side walls;

a spacer arranged to fit into the channel, so as to bear against the side walls and the end wall, the spacer defining an elongated substantially V-shaped fold between two V-wall panels, arranged to receive the edge of the article, with the edge of the article resting in a bottom of the V-shaped fold;

the spacer having two bearing leas comprising elongated panels respectively coupled to the V-wall panels, each of the bearing leas extending from a fold at a junction with one of the V-wall panels to one of the corners of the internal channel; and, wherein the V-wall panels increase in width along the spacer, whereby the bottom of the V-shaped fold is inclined relative to the end wall.

6. The packing structure of claim 5, further comprising a structure fixing the spacer relative to at least one of the sidewalls and the end wall, against displacement along a length of elongation, whereby the V-shaped fold is fixed in depth at any position along the channel.

7. The packing structure of claim 6, wherein the structure fixing the spacer comprises at least one of a fastener affixing the spacer to one of said sidewalls and end wall, and a spacing structure abutting an end of the spacer.

8. The packing structure of claim 6, wherein the spacer further comprises at least one base panel coupled to a fold with at least one of the bearing legs, the base panel being folded to a position parallel to the end wall of the internal channel adjacent to an associated one of the corners of the internal channel, and wherein the structure fixing the spacer comprises an attachment of the base panel to the end wall.

9. A packing structure for an article with an elongated edge, the structure comprising:

at least a partial enclosure with spaced side walls coupled by an end wall; defining an internal channel with corners at junctions of the end wall and the side walls;

a spacer arranged to fit into the channel, so as to bear against the side walls and the end wall, the spacer defining an elongated substantially V-shaped fold between two V-wall panels, arranged to receive the edge of the article, with the edge of the article resting in a bottom of the V-shaped fold;

the spacer having two bearing leas comprising elongated panels respectively coupled to the V-wall panels, each of the bearing legs extending from a fold at a junction with one of the V-wall panels to one of the corners of the internal channel;

wherein the enclosure comprises a rectilinear carton having spaced said side walls, coupled at ends of the carton with two said end walls, coupled along a bottom wall and a too wall of the carton, and wherein at least two opposed ones of said walls each are provided with at least one said spacer, the resoective said spacers defining between them a support for the article; and, wherein the too and bottom walls of the carton, and the end walls of the carton, each contain opposed pairs of said spacers wherein the opposed pair of said spacers at the end walls each have V-wall panels that increase in width along the spacer, whereby the bottom of the V-shaped fold is inclined relative to the end wall.

10. The packing structure of claim 9, wherein the spacers at the end walls are oriented to that the V-wall panels increase in width proceeding in a same direction toward a bottom of the carton.

11. The packing structure of claim 10, further comprising a structure fixing the spacers at the end walls at a predetermined position relative to the bottom of the carton.

12. The packing structure of claim 11, wherein the spacers at the end walls are affixed to the carton by fasteners fixing said predetermined position.

13. The packing structure of claim 12, wherein the carton and the spacers are dimensioned for holding a sheet element having an edge.

14. The packing structure of claim 13, further comprising a flat segment extending between bottoms of the V-shaped panels, the flat segment bearing against the edge.

* * * * *